US012668929B1

(12) United States Patent
Perez Alvarez de la Campa et al.

(10) Patent No.: US 12,668,929 B1
(45) Date of Patent: Jun. 30, 2026

(54) METHOD FOR REPURPOSING CRACKED DRIVEWAYS

(71) Applicants: Zoila Maria Perez Alvarez de la Campa, Miami, FL (US); Giselle Yanet Alvarez de la Campa, Miami, FL (US); Gipsy Juliette Alvarez de la Campa, Miami, FL (US); Osvaldo Alvarez de la Campa, Miami, FL (US)

(72) Inventors: Zoila Maria Perez Alvarez de la Campa, Miami, FL (US); Giselle Yanet Alvarez de la Campa, Miami, FL (US); Gipsy Juliette Alvarez de la Campa, Miami, FL (US); Osvaldo Alvarez de la Campa, Miami, FL (US)

( * ) Notice: Subject to any disclaimer, the term of this patent is extended or adjusted under 35 U.S.C. 154(b) by 408 days.

(21) Appl. No.: 18/413,868

(22) Filed: Jan. 16, 2024

(51) Int. Cl.
*E01C 7/14* (2006.01)

(52) U.S. Cl.
CPC ..... *E01C 7/147* (2013.01)

(58) Field of Classification Search
CPC ..... E01C 7/147
USPC ..... 404/75, 94, 107
See application file for complete search history.

(56) References Cited

U.S. PATENT DOCUMENTS

| | | | | |
|---|---|---|---|---|
| 7,273,048 | B1 * | 9/2007 | Zuzelo | B28D 1/042 125/13.01 |
| 8,167,513 | B2 * | 5/2012 | Ryan | E01C 23/06 404/101 |
| 8,377,348 | B1 * | 2/2013 | Montemayor | E01C 11/005 404/75 |
| 10,240,306 | B2 * | 3/2019 | Lorenz | B24B 7/186 |
| 11,326,310 | B2 | 5/2022 | Velazquez | |
| 2005/0191133 | A1 * | 9/2005 | Purcell | G02B 6/504 405/157 |
| 2013/0216306 | A1 * | 8/2013 | Konczak | E01C 7/187 404/75 |
| 2014/0270952 | A1 * | 9/2014 | Karsten | E01C 23/088 404/75 |
| 2023/0295454 | A1 | 9/2023 | Wakelam | |

FOREIGN PATENT DOCUMENTS

| | | | | |
|---|---|---|---|---|
| CN | 112176817 A | * | 1/2021 | E01C 11/14 |
| CN | 116716769 A | * | 9/2023 | E01C 7/351 |

* cited by examiner

*Primary Examiner* — Raymond W Addie
(74) *Attorney, Agent, or Firm* — Sanchelima & Associates, P.A.; Christian Sanchelima; Jesus Sanchelima

(57) ABSTRACT

A method for repairing cracked concrete including the steps of creating purposeful grooves along the cracks. The extracted concrete is then broken down into pieces of a size not exceeding the width of the grooves. Following this, a thorough cleaning of the grooves is conducted. A compacted layer of a granular material is placed all over the grooves, then a high-density mesh is placed on top. Subsequently, an amalgamation of repurposed concrete and hydraulic concrete is expertly poured over the grooves. The method culminates with the application of a final finish across the entire driveway, imparting heightened durability. Additionally, a touch of aesthetic flair is introduced through the mounting of a decorative element on the compacted concrete. This method uniquely combines structural repair with visual enhancement, offering a comprehensive solution for cracked concrete driveways.

1 Claim, 4 Drawing Sheets

METHOD FOR REPURPOSING CRACKED DRIVEWAYS

BACKGROUND OF THE INVENTION

1. Field of the Invention

The present invention relates to methods for repurposing cracked driveways and, more particularly, to a methodology for repairing cracked driveways by excavating channels along the cracks and subsequently repurposing the extracted concrete to fill these channels.

2. Description of the Related Art

Several methods for repairing cracked driveways have been designed in the past. None of them, however, describe a methodology for concrete repair involving the selective removal of concrete around cracks, extending beyond the crack's width and subsequent grinding to create uniform and structured channels in place of the cracks. This process effectively prevents further expansion of the cracks. Furthermore, the concrete that is removed is repurposed to fill these channels.

Applicant believes that a related reference corresponds to U.S. patent No. 2023/0295454 A1 issued for Material restoration composition and method. Applicant believes that another related reference corresponds to U.S. Pat. No. 11,326,310 B2 issued for Concrete and masonry restoration and ornamentation method and apparatus. None of these references, however, teach methods for concrete crack repair involving the excavation of channels in place of the cracks, which are then filled with the concrete that is removed. Following this process, the driveway undergoes additional cleaning and sealing to augment the effectiveness of the repair. The environment is not adversely affected since the concrete that is removed is being repurposed.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a method that bolster the durability of the driveway by eliminating cracks.

It is another object of this invention to elevate the visual appeal of the driveway by filling the cavities or channels with decorative ornamental rocks or turf.

It is still another object of the present invention to offer sustainable repurposing of the concrete that is removed with an eco-friendly approach.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
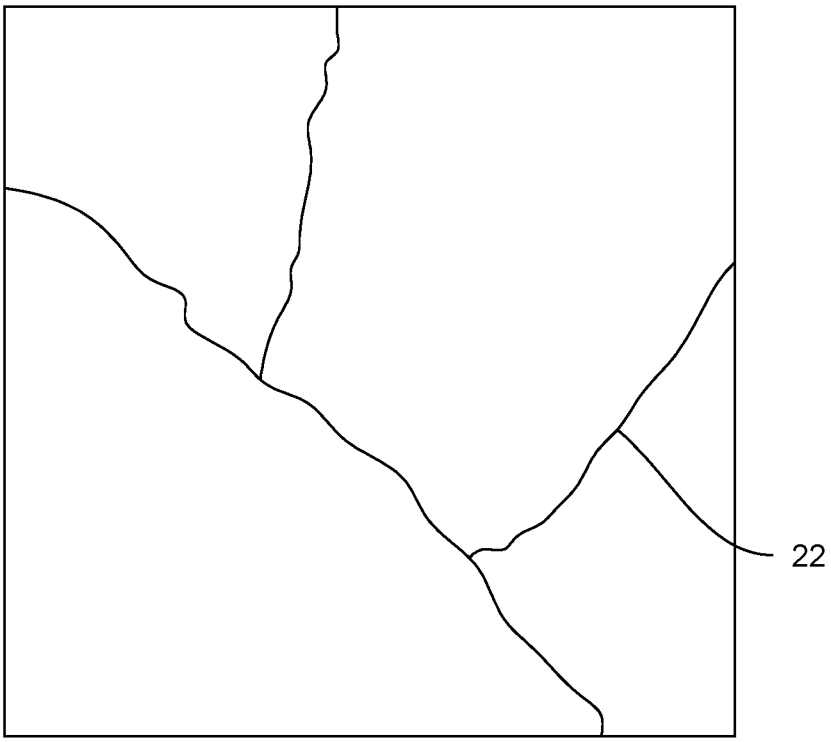
FIG. 1 represents a top view of the cracks 22 before applying the repurposing cracked methodology.

Referring now to the drawings, where the present invention is a method for repairing cracked concrete driveways. Also, singular words should be read as plural and vice versa and masculine as feminine and vice versa, where appropriate, and alternative embodiments do not necessarily imply that the two are mutually exclusive.

In the initial step 20, the method involves identifying the specific cracks 22 slated for repair. As FIG. 1 illustrates.

Figure 2:
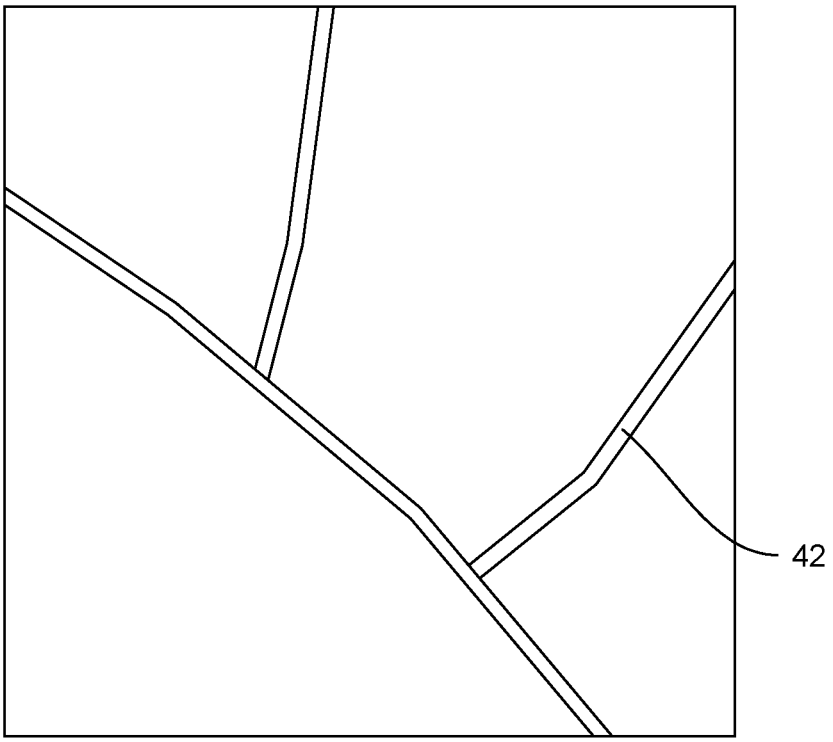
FIG. 2 shows a top view of the grooves 42 created in step 40.

The subsequent step 40 requires cutting through the concrete slab to access the compacted bed 44 beneath. This cutting process extends beyond the cracks 22, establishing parallel and spaced-apart walls perpendicular to the compacted bed 44, thereby forming grooves 42. Best observed in FIG. 2.

In the third step 60, the concrete situated between the walls is extracted and subsequently ground into pieces of predetermined dimensions, such as ¾ to 1½ inches, or a size smaller than the created grooves 42.

Moving to the fourth step 80, the formed grooves 42 are meticulously cleaned, and the exposed structural support of the driveway is restored by applying an anticorrosive material 82 to the rods. Best depicted in FIG. 3.

Figure 3:
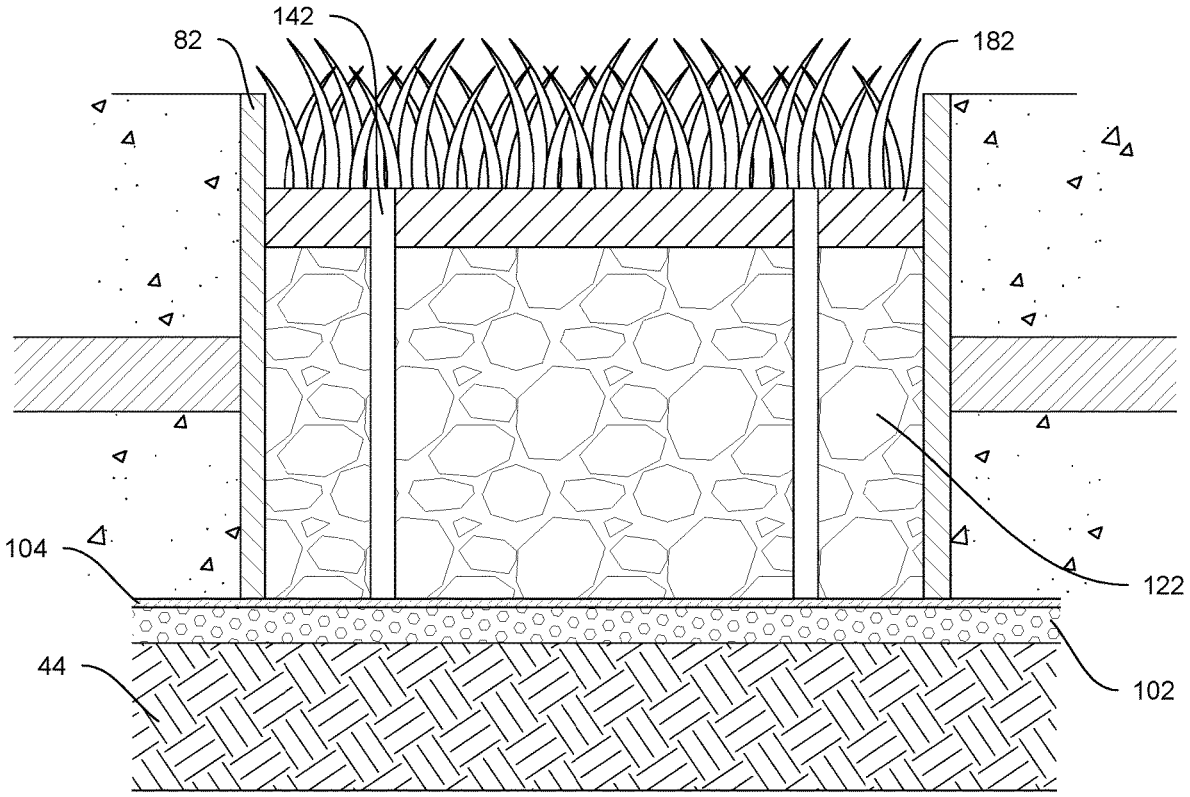
FIG. 3 illustrates a front cross-sectional view of the groove 42 shown in FIG. 2 after it has been cleaned and the removed concrete repurposed. The figure further shows an optional decorative element 182 covering the repurposed concrete.

In step eight 100, a compacted layer 102 of granular material, such as sand or an equivalent, is deposited within the grooves 42. Atop this compacted layer, a high-density mesh 104 is positioned. This high-density mesh 104 acts as a barrier against weed formation, facilitating proper concrete curing by preserving humidity. As FIG. 3 represents.

Following this, in the sixth step 120, the ground concrete is combined with hydraulic concrete, and this amalgamation 122 is poured over the formed grooves 42, establishing a layer that partially covers said grooves 42 along their length. As FIG. 3 shows.

The seventh step 140 involves the creation of air vents 142 before the curing of the repurposed concrete and hydraulic concrete amalgamation 122. These strategically positioned air vents 142 serve the dual purpose of facilitating water drainage, thus preventing potential damage due to prolonged water exposure, and resisting the formation of new cracks under the stress exerted by vehicular weight. Best depicted in FIG. 3.

In the eight step 160, a finishing touch is applied to the driveway, encompassing processes like pressure washing and painting. This step 160 not only enhances the overall repair but also serves as a preventive measure against the emergence of new cracks. The comprehensive nature of this seventh step ensures a well-rounded approach to driveway maintenance and longevity.

Finally, the ninth step 180 introduces a decorative element 182 along the formed grooves 42, such as turf, decorative stones, or equivalent materials. This decorative element 182 is affixed atop the repurposed concrete, providing an aesthetic enhancement to the repaired driveway. Best illustrated in FIG. 3.

Figure 4:
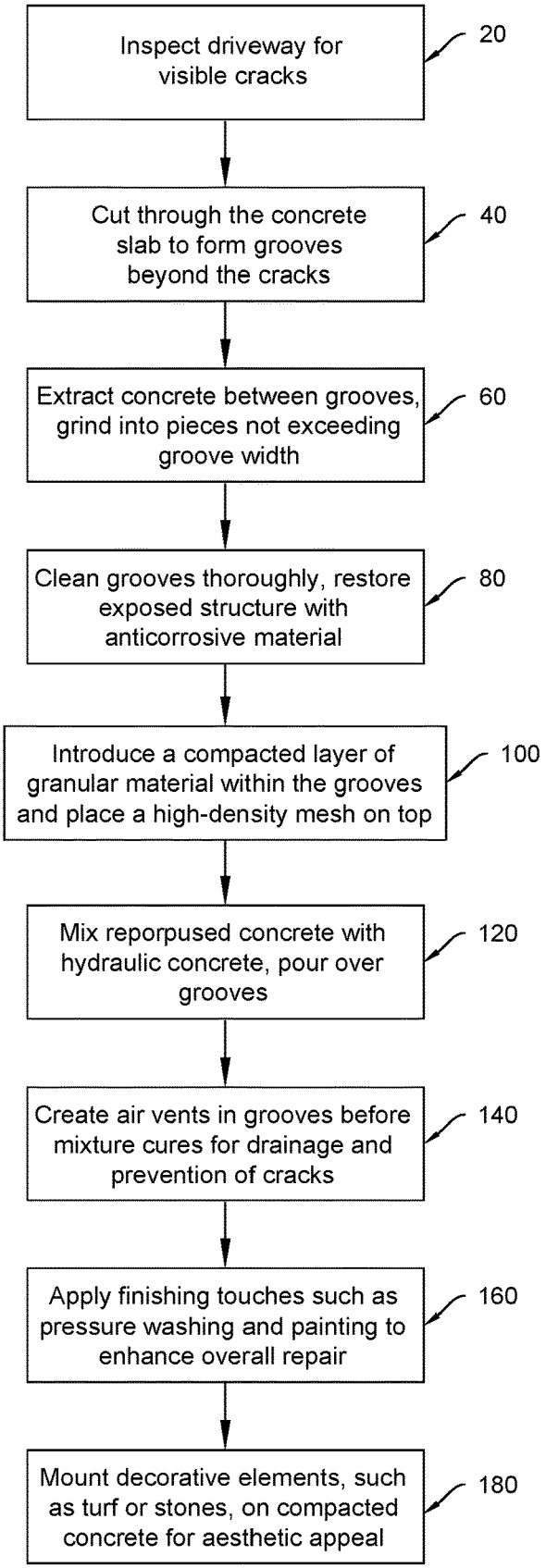
FIG. 4 depicts a block diagram with processes of the method for the present invention.

The invention further includes the structure resulting from the method. FIG. 4.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method for repurposing cracked driveways that includes the following steps of:

a) identifying specific cracks for repair;

b) cutting through a concrete slab to reach a compacted bed beneath, creating parallel and spaced-apart walls perpendicular to the compacted bed, thereby forming grooves;

c) removing and grinding the concrete between the walls into pieces of a predetermined size;

d) cleaning the formed grooves and restoring an exposed structural support of a driveway by applying an anti-corrosive material to the exposed structural support;

e) introducing a compacted layer of a granular material within the grooves, a high-density mesh is placed atop the compacted granular material;

f) combining the ground concrete with hydraulic concrete and pouring a resulting mixture over the formed grooves to create a layer partially covering said grooves along their length;

g) forming air vents before the resulting mixture cures, the air vents serving for water drainage and preventing the driveway damage due to prolonged exposure to water;

h) applying a finish over the driveway, including pressure washing and painting, to enhance overall repair and prevent a formation of new cracks;

i) incorporating a decorative element along the formed grooves, mounted on top of the resulting mixture.

* * * * *